US006584707B1

(12) United States Patent
Racine et al.

(10) Patent No.: US 6,584,707 B1
(45) Date of Patent: Jul. 1, 2003

(54) ATHLETIC SHOE WITH AN ADJUSTABLE SIZING SYSTEM

(75) Inventors: Bertrand Racine, Portland, OR (US); Christopher D. Carle, Portland, OR (US); Daniel A. Johnson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/299,695

(22) Filed: Nov. 20, 2002

(51) Int. Cl.[7] ..... A43B 3/26

(52) U.S. Cl. ..... 36/97; 36/112; 36/71; 36/81

(58) Field of Search ..... 36/97, 112, 71, 36/81, 105, 132, 136, 72 R, 1.5, 2 R, 72 B, 58.5, 58.6, 92, 8.4

(56) References Cited

U.S. PATENT DOCUMENTS

| | | | | | |
|---|---|---|---|---|---|
| 354,360 | A | | 12/1886 | Taber | |
| 1,515,086 | A | | 11/1924 | Baluta | |
| 1,926,818 | A | | 9/1933 | Ratcliff | |
| 2,054,958 | A | | 9/1936 | Tousley | |
| 3,431,658 | A | | 3/1969 | Finn | |
| 3,618,232 | A | | 11/1971 | Shnuriwsky | |
| 3,810,318 | A | * | 5/1974 | Epstein | 36/105 |
| 4,503,628 | A | | 3/1985 | Mancinelli | |
| 4,642,916 | A | | 2/1987 | Collins | |
| 4,662,087 | A | * | 5/1987 | Beuch | 36/71 |
| 4,724,627 | A | * | 2/1988 | Sisco | 36/71 |
| 4,835,886 | A | * | 6/1989 | Chemello et al. | 36/71 |
| 5,090,140 | A | | 2/1992 | Sessa | |
| 5,109,614 | A | | 5/1992 | Curry | |
| 5,430,961 | A | * | 7/1995 | Faulconer et al. | 36/71 |
| 5,733,647 | A | | 3/1998 | Moore, III et al. | |
| 5,842,292 | A | * | 12/1998 | Siesel | 36/58.5 |
| 6,286,232 | B1 | | 9/2001 | Snyder et al. | |
| 6,442,874 | B1 | | 9/2002 | Long | |

FOREIGN PATENT DOCUMENTS

| | | |
|---|---|---|
| WO | WO 02/13641 | 2/2002 |

* cited by examiner

*Primary Examiner*—Anthony D. Stashick
(74) *Attorney, Agent, or Firm*—Banner & Witcoff, Ltd.

(57) ABSTRACT

An article of footwear is provided that includes a sizing apparatus to allow the shoe size to be adjustable by the wearer. The article of footwear in the form of a shoe includes a sole, an upper extending from the sole, and a sizing apparatus located within the upper, in which a sizing member is attached to the upper at the rear end of the shoe. The sizing apparatus may include a composite inner core, a detachment feature, and a dual selective fastening system. The inner core may be substantially enclosed in a lining. The sizing apparatus enables a user to adjust the effective length of the shoe to at least three effective lengths. A method of adjusting the size of the article of footwear is provided to make the shoe at least three effective lengths.

37 Claims, 8 Drawing Sheets

ATHLETIC SHOE WITH AN ADJUSTABLE SIZING SYSTEM

FIELD OF INVENTION

The present invention generally relates to footwear, in particular, to athletic shoes that include an adjustable sizing system.

BACKGROUND

Consumers purchase shoes and other footwear for use in athletic activities such as running, cross training, soccer, football, baseball, tennis, walking, and the like. In recent years, sports directed to children have been very popular. In order for these children to compete effectively and to reduce immediate and future podiatric problems, it is essential that they wear shoes that are sized properly.

As children grow, consumers purchase numerous pairs of athletic shoes of increasing sizes to maintain the pace of the child's growth. In general, the feet of children grow quickly during the younger years and decelerate as the children reach maturity. Many parents have purchased shoes for their children only to be dismayed that the child has grown out of the shoes before the shoes have been barely worn. This problem is magnified for certain shoes made for specific seasonal sports where the wearable season is short. To avoid the cost of replacing shoes on a frequent basis, some parents might purchase shoes in larger sizes in an effort to preempt the growth of the feet. Alternatively or additionally, some parents may have their children wear the shoes even when the child has slightly outgrown them. Neither of these practices are desired because the shoes will not likely fit properly for the wearer. Improper or poorly fitting footwear may effect the athletic performance of the child or could aggravate medical problems associated with the foot.

In general, most children's feet grow approximately one full shoe size in a year, or one-half shoe size about every four months to six months. Consequently, the shoes need to be purchased frequently to accommodate the growing child. The feet of children may grow about one-third inch or more in length within a year. For families on limited budgets, the additional costs may create problems or cause the parents to forego the athletic activity. Some parents may forego purchasing new shoes and keep the poor-fitting shoes on the children. Unfortunately, this unintended problem may lead to effecting the proper growth and development of the feet of the children or could for cause future medical problems. Thus, it is advantageous to extend the life of footwear to reduce the number of frequent purchases. Also it is advantageous to provide footwear that fits properly for the wearer for as long as possible.

The American standard sizing system has various size designations such as 6, 6½, and 7. Other standard worldwide footwear sizing systems such as the English, European, and metric use similar type sizing arrangements. Under the American standard designation system, 6 and 6½, and 6½ and 7 are considered to be adjacent sizes in the sizing system. These adjacent sizes are also considered to have half-size length differentials while 6 and 7 would be considered as having a full size length differential. The size ranges and designation vary between women, men, girl, boy, and infant footwear. In general, footwear manufacturers provide the shoes in most sizes for each half size length differentials to accommodate the consumer's demand for shoes that properly conform to the feet of the wearer. This is a special consideration when supplying shoes to children.

Manufacturing shoes for each half size can be expensive causing manufacturers to incur additional tooling and setup costs. The additional cost increases through the entire production, distribution, and retail supply channels. In addition, the intermediate sized shoes may increase inventory and carrying costs of the distributor and thus, may also increase the cost to the ultimate consumer who uses the shoes. Thus it is advantageous to reduce the number of differing sized shoes in a product line to reduce the cost of shoes, for the consumer and the manufacturer, if it could be accomplished without sacrificing the consumer's demand for properly fitting shoes.

One solution has been proposed in U.S. patent application Ser. No. 09/640,371 filed Aug. 17, 2000 to Bradley Long, now U.S. Pat. No. 6,442,874 which is herein fully incorporated by reference. In an embodiment, the Long application discloses a single adjustable sizing member for an athletic shoe in which the sizing member is attached to the upper at the rear end of the athletic shoe. While the sizing member of Long is effective, improvements can be provided to benefit the wearer of a shoe. In addition, foot movements of which occur in some sports can be addressed to improve enhanced athletic performance.

Heretofore, shoe sizing systems have not adequately, if at all, addressed the demands and biomechanical considerations of the sports as they relate for the performance of athletes. This problem is magnified for growing children commonly who use shoes in the cleated athletic shoe category, such as soccer shoes. Motions prevalent in the sport of soccer, such as side-to-side cutting motions and kicking motions for a ball, may create foot instability leading to fatigue, injury, and inefficiency of footwork action.

By way of example, the foot may experience relatively high impact forces during foot planting movements for ball kicking and/or changing directions. This is a special consideration on artificial surfaces. While artificial surface help make the competition fast paced, artificial surface are generally harder than grass surfaces. Because the artificial surfaces do not absorb impact like grass surfaces, playing on artificial surfaces increases the risk injuries to the lower extremities of the child's body. Past sizing systems for shoes are not adequately, if at all, designed for the dynamics of running and changing direction on such turf conditions to alleviate the risks of injury.

The significant interaction of forces on the shoe may cause the heel portion of the upper to flex or rollover in a medial-to-lateral motion or lateral-to-medial motion, depending on the foot strike action. This rollover motion undesirably makes the foot lose mating contact with the upper, particularly in the heel and heel tendon. Consequently, the shoe may lose some traction, and the athlete may be left in an awkward position following the planting movement, which can adversely affect the passing and shooting performance of the soccer athlete. Furthermore, making contact on a firmly planted ankle with ill-fitting shoes may forcibly cause joint and ligament damage in the foot resulting in an increase likelihood of a sprain. Additionally or alternatively, past sizing systems have not addressed fit of the shoe for cutting or side-to-side motions for these types of foot movement. These side-to-side motions can interact to apply oblique forces to various portions of the foot, which can lead to injury, fatigue, and footwork inefficiency. Hence, an article of footwear with a sizing system for use in the sport of soccer and other similar sports that maximizes performance was needed.

SUMMARY OF THE INVENTION

In view of the foregoing, the present invention pertains to an article of footwear that includes a sizing system to permit the shoe size to be selectively adjustable by the wearer. In an aspect, sizing system permits shoe size adjustment and enhances fit and biomechanical performance of wearer.

In one aspect of the present invention, an article of footwear in the form of a shoe includes a sole, an upper extending from the sole, and a sizing apparatus. The upper has front and rear portions, and a foot opening at the rear portion. The foot opening is positioned to receive a foot of a wearer when the shoe is worn. A sizing apparatus provides the ability to extend the useful life of an athletic shoe for a particular wearer an athletic shoe beyond a conventional intermediate sized shoe and a full shoe size. Further, the sizing apparatus improves the fit of the shoe to prevent heel rollover and compensate for side-to-side foot action.

According to one aspect of the present invention, a sizing apparatus is positionable within a heel portion for engaging a foot of a user. The sizing apparatus includes a first removable member and a second removable member in which the first removable member and second removable member are adapted to be in vertical superimposition with respect to each other and to a heel section of the upper. The first removable member is adapted to be attached to a portion of the heel portion of the upper, and the second removable member is adapted to be substantially pivotally attached to the first removable member. In this manner, selective size adjustment is provided to the wearer. Furthermore, the shoe has selective adjustment for different fit characteristics for the sport of use to improve athletic performance.

According to another aspect of the present invention, an article of footwear includes a sizing apparatus with a first sizing member and a second sizing member. At least one of the sizing members is provided with a composite inner core composed of resilient materials with different resilient properties. The composite inner core may be substantially enclosed between a front cover and a rear cover of at least one of the sizing members. In this manner, the force acting on the heel can be diminished and rollover can be substantially reduced.

According to another aspect of the invention, an articulated sizing system is configured for engaging a foot of a user within a heel portion of an upper. The sizing system includes a first sizing element and a second sizing element coupleable together to adjust a first effective length of the upper, and a second sizing element or the first sizing element configurable to adjust a second effective length of the upper, and the first sizing element or the second sizing element are removably attached to the upper so as to configure the sizing system to adjust a third effective length of the upper.

These and other aspect, features and advantages of the present invention will be apparent upon consideration of the following detailed description thereof, presented in connection with the following drawings, which are included by way of example, and not by way of limitation with regard to the claimed invention in which like reference numerals identifying the elements throughout.

DETAILED DESCRIPTION OF THE PREFERRED EMBODIMENTS

Figure 1:
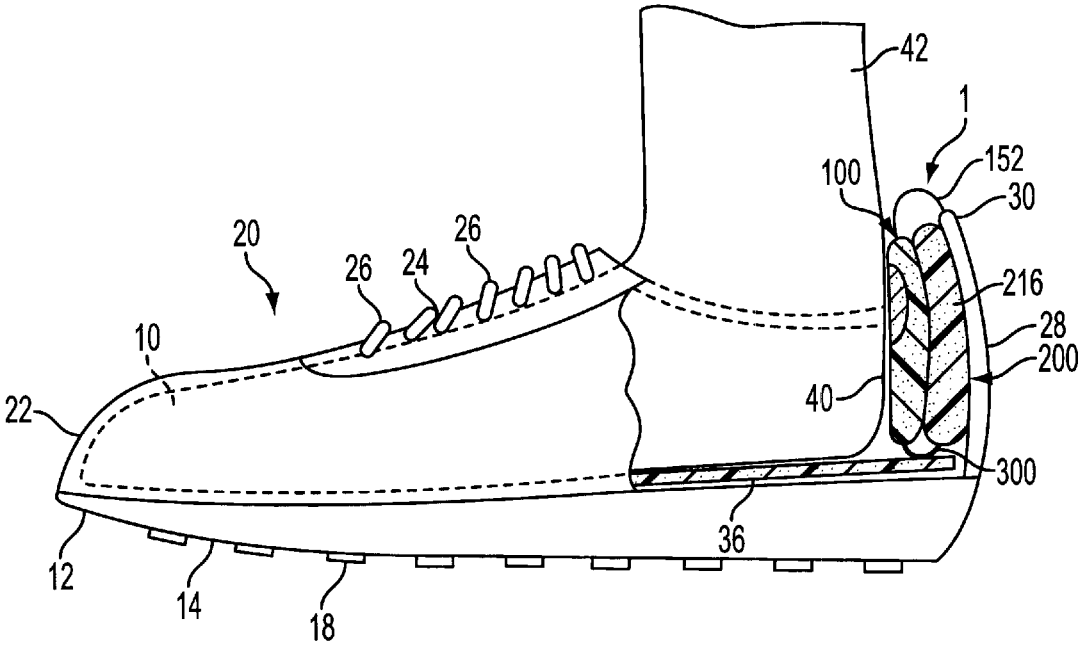
FIG. 1 is a partially broken away side view of a schematic representation of the article of footwear and a sizing apparatus according to the teachings of the present invention.

FIGS. 1–7 depict an article of footwear according to the present invention in the form of an athletic shoe designated generally by reference numeral 20. The shoe 20 includes an upper 10 secured to a sole 12. The sole 12 may include an outer sole 14 and a midsole 16. The shoe 20 may be cleated 18 depending on its sport of intended use, such as for soccer, football, baseball, and the like.

Referring to FIG. 1, the upper 10 may include a forefoot section 22, a heel section 28, an ankle collar 30, and an optionally an insole, also known as a sockliner 36. The upper 10 is fastened or secured around its bottom periphery to the sole 12 by a desirable method such as, stitching or adhesive bonding. The upper 10 includes a desirable fastening system for securing the shoe 20 to the foot 42 of the wearer. For example, the fastening system may include a lace 26 and plurality of eyelets 24 or lace holding elements. The forefoot section 22 extends over the toes of the wearer of the shoe 20. The upper 10 includes a foot opening 31 positioned between the quarter section 38 and the heel section 28 that receives the foot 42 of the wearer.

Figure 6:
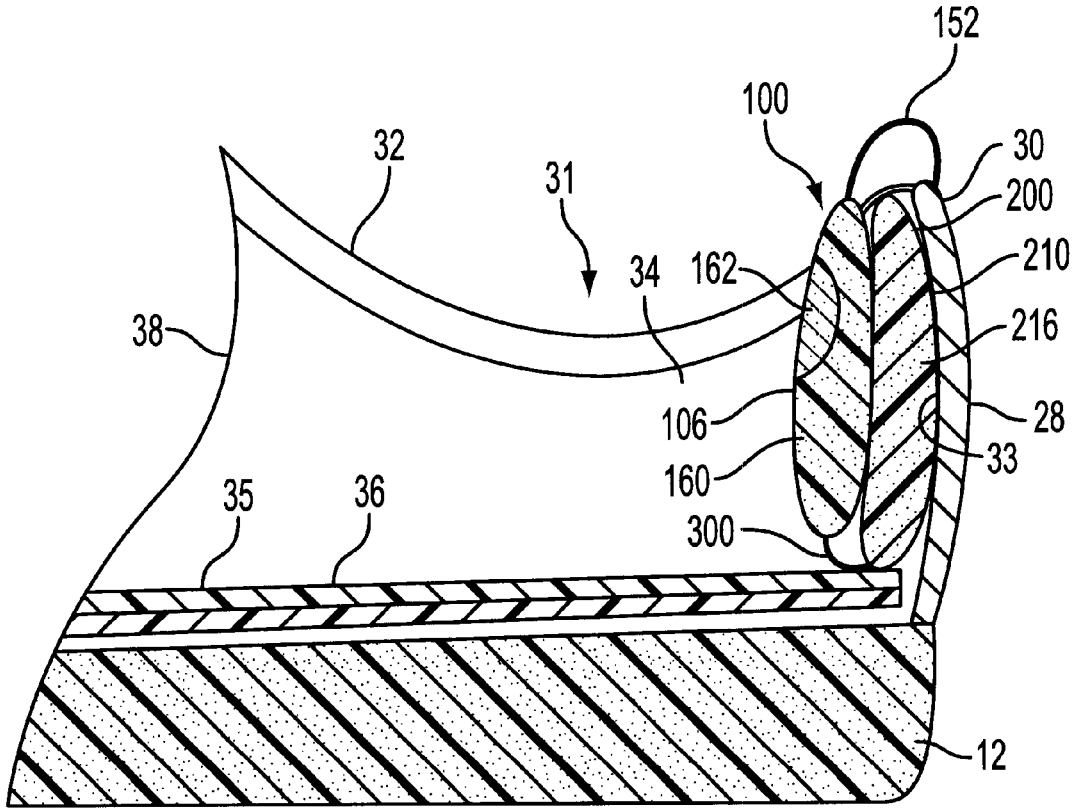
FIG. 6 is a schematic sectional view of a quarter portion of an article of footwear in accordance with the teachings of the present invention wherein the sizing apparatus shown in FIG. 1 is engaged therein.
Figure 7:
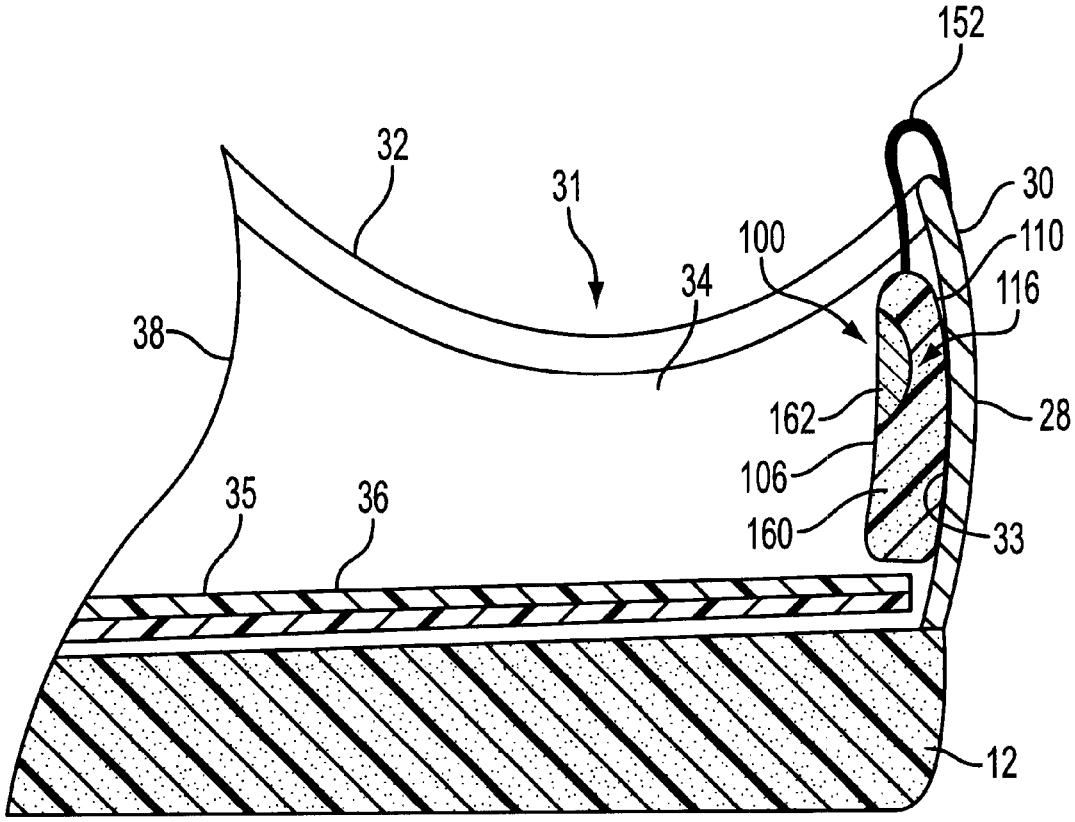
FIG. 7 is a schematic sectional view of a quarter portion of an article of footwear in accordance with the teachings of the present invention wherein a portion of the sizing apparatus shown in FIG. 1 is engaged therein.

The heel section or rear panel 28 of the upper 10 substantially envelops the heel 40 of the wearer and is located at the rear end of the upper 10. As shown in FIGS. 6 and 7, the heel section 28 also includes a heel portion 34 adapted to receive the foot 42 and the heel 40 of the wearer. The periphery of the internal heel portion 34 comprises the area at the rear end of the shoe 20 around the heel 40 connecting the medial side and lateral side of the shoe 20. An inner surface 33 of the internal heel portion 34 is located adjacent to the foot 42. The inner surface 33 is part of the upper 10 and preferably extends from the sole 12 to the collar 32. Though other constructions are possible. The ankle collar 30 is located at the top end of the heel section 28 around the foot opening 31.

The shoe 20 further includes an adjustable sizing apparatus 1 that provides alternative effective sizing distances for the length of the shoe 20 and enhanced biomechanical performance related to fit of the shoe. Referring to FIGS. 1–4, the sizing apparatus 1 includes a forward sizing member 100 pivotally and/or removably attached to a rearward sizing member 200 disposed to engage a foot 42 of a wearer when worn. For ease of explanation of the invention and to assist the reader, forward sizing member 100 is designated to be disposed "in front" of rearward sizing member 200, i.e., towards the forefoot section 22 when in an "in use" position shown in FIGS. 1 and 6. It is to be understood that rearward sizing member 200 may be disposed in front of forward sizing member 100 as well, if an alternative fit performance is deemed acceptable for the intended sport of use.

Figure 5A:
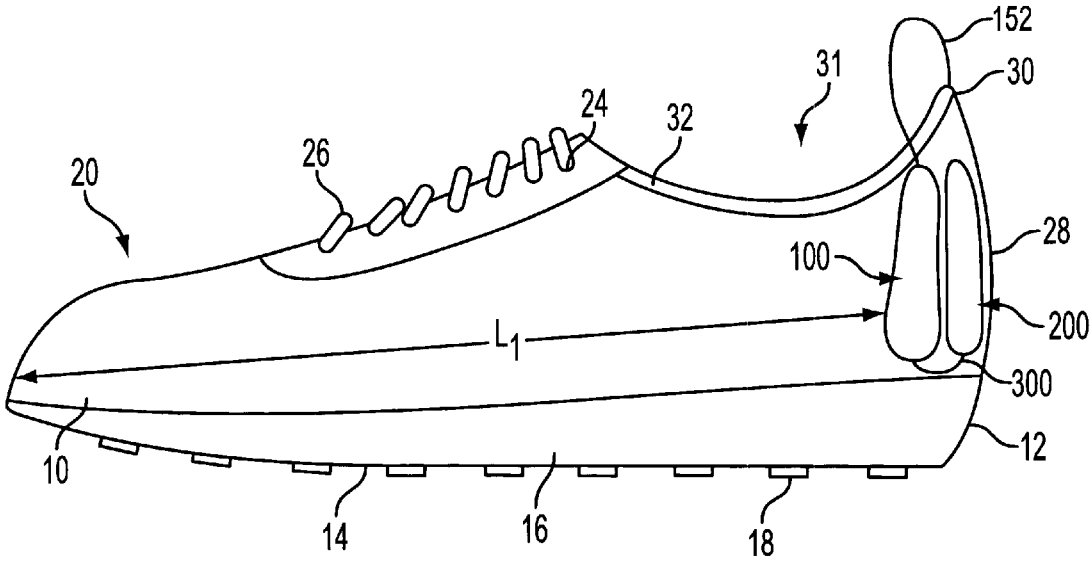
FIG. 5A is a side elevational view of a schematic representation of an article of footwear illustrating a first effective length of the article according to the teachings of the present invention.
Figure 5B:
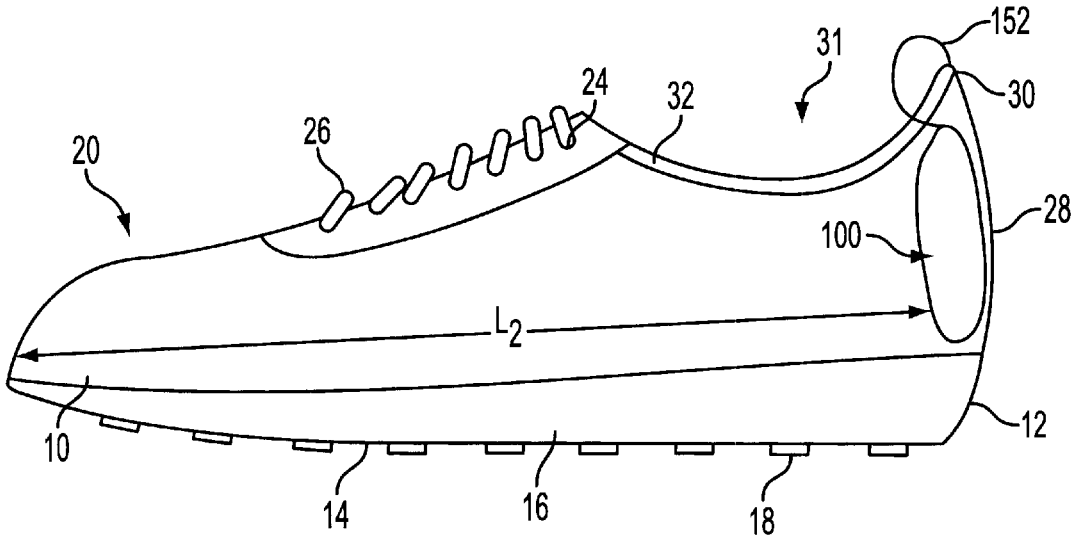
FIG. 5B is a side elevational view of a schematic representation of an article of footwear illustrating a second effective length of the article according to the teachings of the present invention.
Figure 5C:
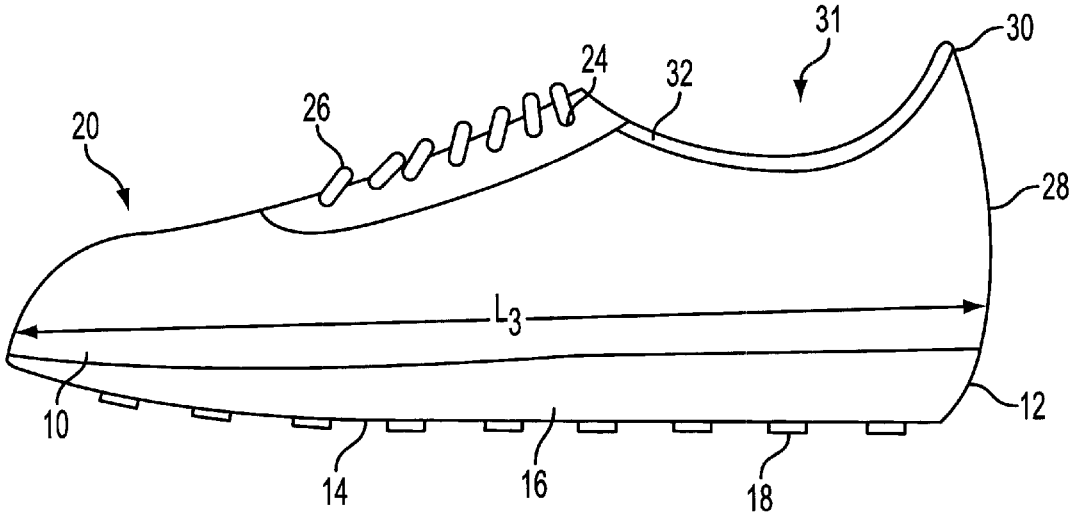
FIG. 5C is a side elevational view of a schematic representation of an article of footwear illustrating a third effective length of the article according to the teachings of the present invention.

The sizing apparatus 1 provides selective size adjustment for shoe 20 as explained hereinafter. The sizing apparatus 1 is movably attached to the upper 10 for eventual removal from the shoe 20 or for alternate positioning on the shoe 20. The sizing apparatus 1 is preferably disposed inside of the opening 31 of the upper 10 when in an "in use" position as shown in FIGS. 1, 6, and 7. Accordingly, the sizing apparatus 1 extends the useful life of the shoe 20 by permitting the wearer to adjust the effective length of the shoe 20 in at least three predefined lengths. In an illustrative arrangement shown in FIG. 5A, a first effective length is created when both forward sizing member 100 and rearward sizing member 200 are disposed in the foot opening 31 in shoe 20. As shown in FIG. 5B, a second effective length is provided when member 200 is removed and sizing member 100 is retained the foot opening 31 of shoe 20. Likewise, as shown in FIG. 5C, a third effective length is formed when member 100 and member 200 are removed from the foot opening 31. In this way, the shoe 20 is selectively shoe size adjustable for the wearer.

More specifically, in a preferred use position, the forward sizing member 100 contacts or otherwise engages the heel 40 of the wearer to provide a high degree of comfortable fit, performance, and sizing of shoe 20. The rearward sizing member 200 cooperates with forward sizing member 100 to provide enhanced fit and sizing of shoe 20 and provides an alternative effective length. In the position shown in FIGS. 1 and 6, the sizing apparatus 1 performs the function of a multi-separable spacer to substantially space the rear of the foot 42 of the wearer from the heel section 28 and to shorten the effective length of the shoe 20. Thus, when in an "in use" position shown in FIGS. 1, 6, and 7, sizing apparatus 1 acts to increase the thickness of the rear wall of the shoe 20, which in turn, decreases the effective length of the shoe 20. In one preferred construction shown in FIG. 7, the thickness may be substantially correspond to at least one-half shoe size based on a standard foot size measurement system, such as the American sizing system. In a more preferred construction, the thickness increase can be substantially correspond to an adjacent full shoe size when both members 100, 200 are together in an "in use" position (see FIGS. 1, 5A, and 6).

Figure 2:
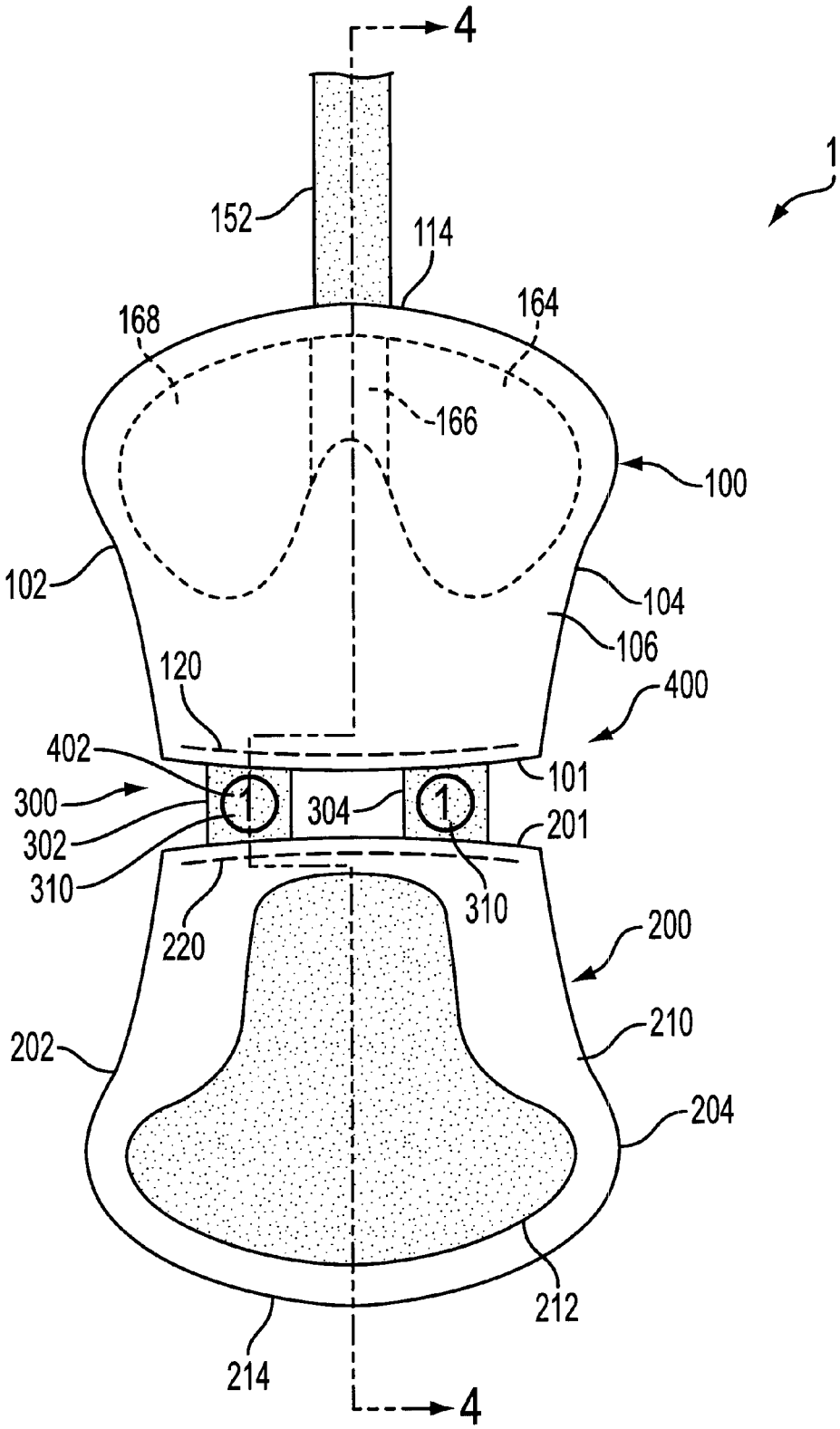
FIG. 2 is a front view of a schematic representation of the sizing apparatus shown in FIG. 2 in an disengage position thereof.
Figure 3:
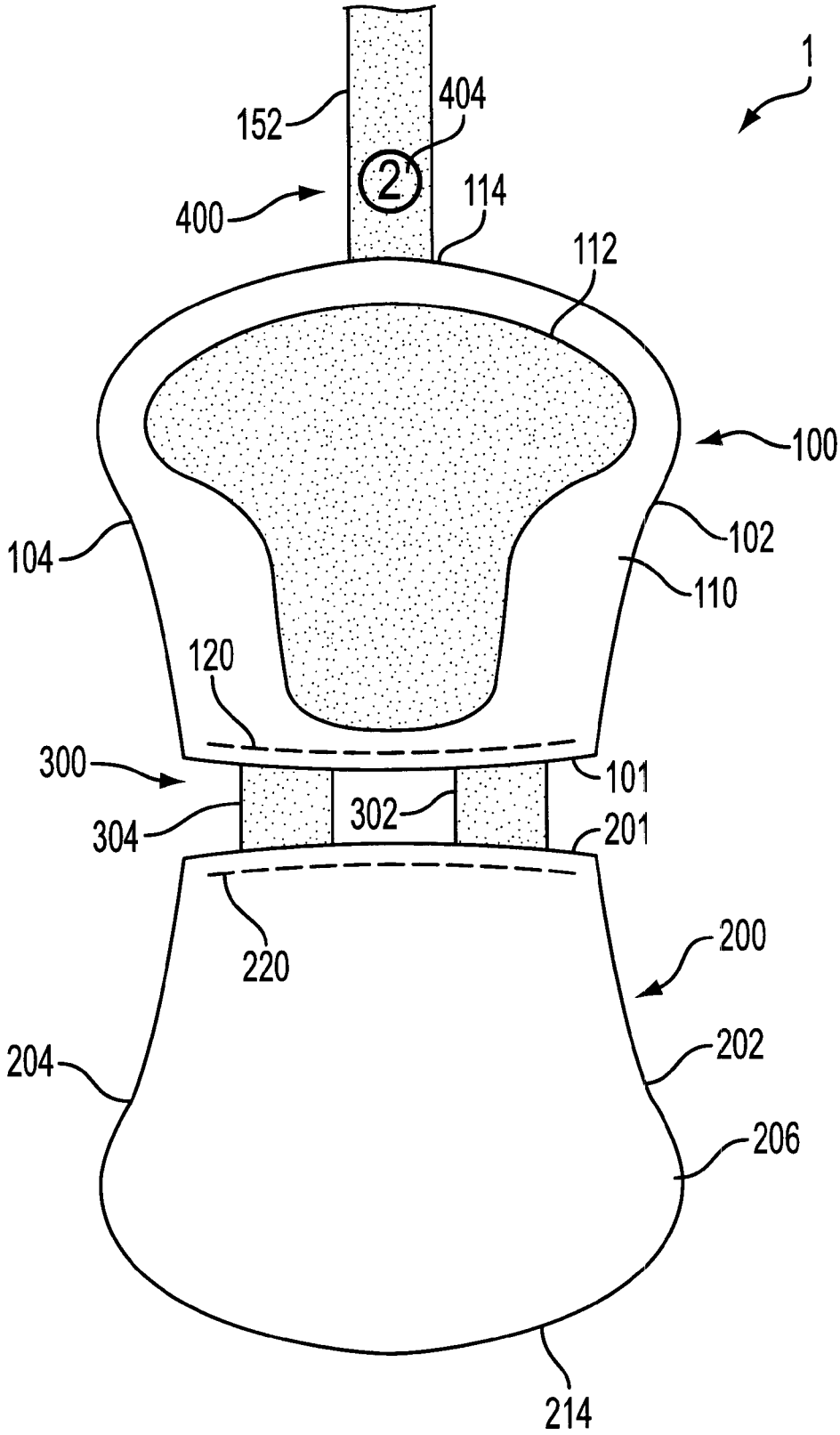
FIG. 3 is a rear view of a schematic representation of the sizing apparatus shown in FIG. 2 thereof.

Purely for ease of explanation, referring to FIGS. 2 and 3, the forward sizing member and the rearward sizing member 200 have a lateral side 102, 202 and a medial side 104, 204, respectively. The designations of medial and lateral correspond to the side of the shoe that the sizing members 100 and 200 are disposed when they are disposed in an in-use position.

Figure 4:
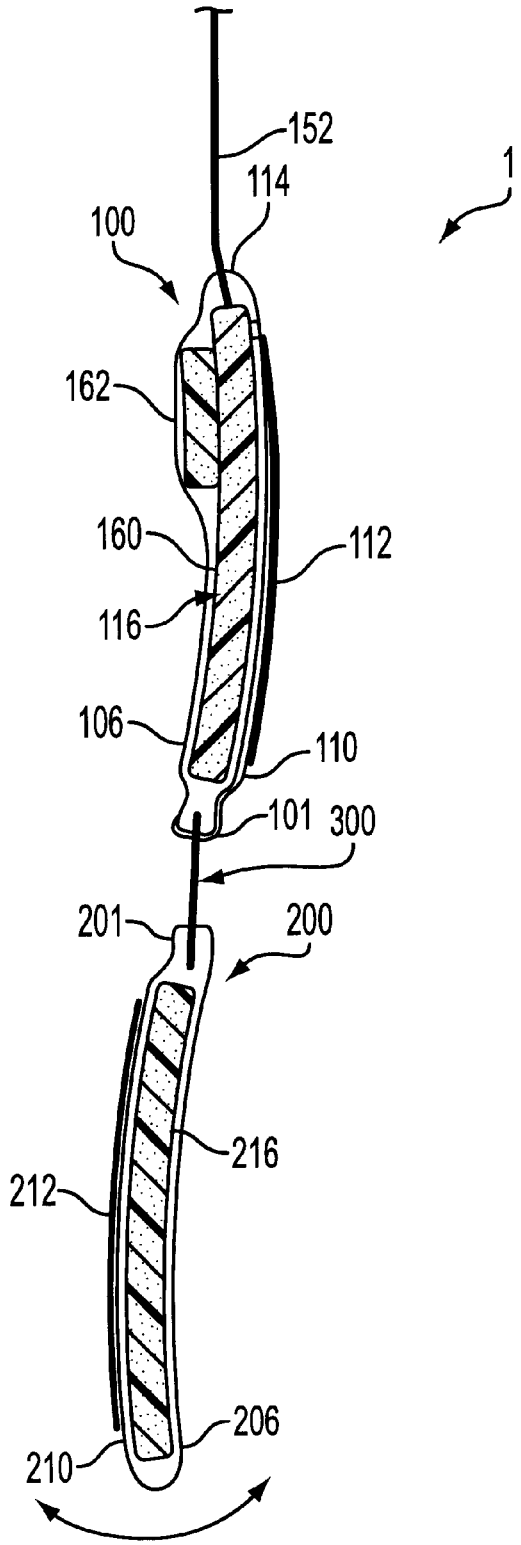
FIG. 4 is a cross sectional view taken along line 4—4 of FIG. 2.

Both the lateral side 102, 202 and medial side 104, 204 may have a "waisted" periphery from top to bottom. This waisted structure advantageously permits the sizing members 100 and 200 to better substantially conform to the inner surface 33 of the internal heel section 34 without bunching, and thereby providing an improved fit for the wearer. Referring to FIG. 4, the each of sizing members 100, 200 preferably includes padding or cushioning having sufficient thickness to reduce the effective length of shoe 20 by the difference in effective length between adjacent shoe sizes. In combination of forward sizing member 100 and rearward sizing member 200, the difference in effective length may be a substantially one full shoe size or another variation. In a preferred arrangement, the difference in effective length provided by the forward sizing member 100 or rearward sizing member 200 corresponds to adjacent shoe sizes in a standard shoe sizing system, such as the American sizing system or the European sizing system.

Referring to FIGS. 2–4, in one arrangement, the forward sizing member 100 and rearward sizing member 200 include a front covering 106, 206, a center core 116, 216, and a rear covering 110, 210, respectively. The front covering 106, 206 includes an outer surface that contacts and engages the heel 40 of the wearer. The center core 116, 216 is substantially encased and disposed between the front cover 106, 206 and rear cover 110, 210. The inner core 116, 216 may be enclosed in a substantially air tight structure formed by the covers 116 and 110, 206 and 210. This protects the core 116, 216 from moisture and other environmental factors that can potentially cause damage to the core 116, 216. The center core 116, 216 may be composed of resilient foam material, such as polyurethane (PU) open cell, PU closed cell, or a similar material. The front covering 106, 206 and rear covering 110, 210 may be attached together by suitable arrangement such as by stitching 120, 220 disposed at or adjacent their periphery.

With reference to FIG. 4, in an illustrative construction, the forward sizing member 100 includes compressible core 116 having a bifurcated or a composite construction. The core construction substantially reduces fatigue, injury, and inefficiently of footwork by reducing at least rollover. In one composite construction, the core 116 includes at least two materials with different compressible properties. In one arrangement, the materials are resilient in which a first core layer 160 is disposed adjacent to the inner surface of rear covering 110. Likewise, a second core layer 162 is disposed adjacent to the inner surface of front covering 106.

The composite core 116 including the first core layer 160 with second core layer 162 provides for an improved fit of the sizing apparatus 1 against the heel of the wearer. In a first arrangement of the core 116, the first core layer 160 has less resiliency than the second core layer 162, that is the second core layer 162 is more compressible than that of the first core layer 160. Accordingly, the first core layer 160 may be constructed of a PU open cell foam, PU closed cell foam or a similar material. The second core layer 162 can be provided with a low recovery foam. In one arrangement, the layer 160 and layer 162 may be laminated to each other. In an alternative arrangement (not shown), the second core layer 162 is received within a cavity formed in the first core layer 160. The peripheral shape of the first core layer 160 and second core layer 162 may also have a peripheral outline of the front covering 106 and rear covering 110 or other shapes.

In a construction of a composite core, the second core layer 162 is disposed to substantially engage an upper portion of the heel of a wearer. Shown in phantom lines in FIG. 2, the second core layer 162 has a medial portion 164 with a central or intermediate portion 166 disposed between a lateral portion 168. The central portion 166 can have a width substantially sized for engaging the Achilles heel tendon of the wearer to reduce developed stress on the tendon. In the second core layer 162, the portions 164, 166, and 168 may be integrally molded or die cut from a single material. A single material enables uniform transfer of compressive stresses between the portions (164, 166, 168) and the reduction of point loads on the tendon or other portions of the heel.

To provide improved side-to-side fit, particularly during cutting motions of the foot, the medial portion 164 and lateral portion 168 is provided with a greater thickness than the thickness of central portion 166. Accordingly, when in an "in use" position (FIGS. 1, 6 and 7), core layer 162 with medial portion 164 and lateral portion 166 reliably folds or envelopes around the corresponding medial and lateral sides of the Achilles tendon of the wearer. Advantageously, this construction forms a cradle-like structure defining a pocket that reliably holds and secures the foot during forward foot propulsion and/or side-to-side motion to keep the shoe in tight abutment the foot and to reduce impact forces injuries to the foot.

In one arrangement, the forward sizing member 100 and rearward sizing member 200 are manufactured with the front covering 106, 206 including a woven material. The rear covering 110, 210 includes a backing material such as, non-woven polyester. The front covering 106, 206 and rear covering 110, 210 are attached to one another and fastened around the periphery of the forward sizing member 100 and rearward sizing member 200 with a fastening member 120, 220 such as, adhesive bonding or stitching. Alternatively, the front covering 106, 206 and rear covering 110, 210 may be composed of the same material. In a preferred construction, the thickness of each sizing members 100 and 200 is provided to corresponding to at least one-half shoe size when engaged in an "in use" position. In one construction, the thickness of the sizing members 100 and 200 is approximately 10.0 mm each, and alternatively, may range between 3.2 mm to 10 mm (0.125 to 0.40 inches). The front covering 106, 206 may have a 1.1 mm thickness and the rear covering 110, 210 may have a 0.8 mm thickness. The center core 116, 216 thickness may range between 6.0 to 8.0 mm.

Referring to FIGS. 2 and 3, the rear covering 110, 210 preferably includes at least a portion of a fastening system, such as first fastening element 112 on rearing cover 110 of forward sizing member 100 (see FIG. 3) and second fastening element 212 on rearing cover 210 of rearward sizing member 200 (see FIG. 2). In one "in use" position shown in FIGS. 1 and 6, the first fastening element 112 securely and releasably couples the forward sizing member 100 to the rearward sizing member 200 on the surface area of the front covering 206. Likewise, second fastening element 212 securely and releasably couples the rearward sizing member 200 to the surface 33 in the internal heel section 34 of the upper 10.

In an alternative "in use" position shown in FIG. 7, when rearward sizing member 200 is repositioned or removed from foot opening 31, the forward sizing member 100 may be alternatively coupled to the surface 33 of heel section 34 by first fastening element 112 to create the second effective length of shoe 20. Nevertheless, the fastening. elements 112, 212 allows the forward sizing member 100 and rearward sizing member 200 to be separable or releasable from the inner surface 33 or from each other, when desired by the wearer. This separation may be accomplished by applying a releasing force on the forward sizing member 100 or rearward sizing member 200 of sufficient magnitude to break an adhesive or a mechanical bond. The fastening elements 112, 212 are used as an aid to prevent side-to-side movement or shifting of the sizing member 100 when the shoe is worn.

In one illustrative construction, each of the fastening elements 112, 212 includes a mechanical locking component, for example a hook and loop closure component. Suitable mechanical locking systems are commercially available such as VELCRO® manufactured by VELCO USA, Inc. The depicted sizing apparatus 1 includes, the fastening elements 112 and 212 having hooks on the outside of the rear covering 110, 210. Front covering 106 of forward sizing member 100, front covering 206 of rearward sizing member 200, and inner facing surface 33 of the heel section 34 may be provided with a woven or other similar material having interstices between its fibers. Commercially available DURAPLUSH® is one type of woven material that could be used instead of 20. In effect, the interstices between the fibers of the material act as loops and lockingly receives the hooks on the rear covering 110, 210. This construction provides a holding force between the forward sizing member 100 and rearward sizing member 200 as well as the heel section 34. Additionally, forward sizing member 100 and rearward sizing 200 are prevented from shifting with respect to each other and sizing apparatus 1 is prevented from shifting in the shoe 20 when worn. Nevertheless, alternative suitable fastening systems may be used.

As previously described, the forward sizing member 100 and rearward sizing member 200 of the sizing apparatus 1 are preferably coupled to the upper 10 for eventual removal from the shoe 20. In one arrangement, the forward sizing member 100 includes a top portion 114 that is attached or coupled to or adjacent to the ankle collar 30 of the heel section 28. A strap member 152 or an extension of the material on the forward sizing member 100 preferably accomplishes the coupling. In the arrangement depicted in FIGS. 2 and 3, the top portion 114 of forward sizing member 100 includes flaccid strap member 152 attached at one end and attached to the other end to the upper 10 (see FIG. 1). The strap 152 may be attached to the forward sizing member 100 in a conventional manner. By way of example, strap 152 may be sewn and such may be accomplished by inserting an end of the strap 152 between the front and rear covering 106 and 110 so that the strap 152 is sewn together with the covering 106 and 110. Referring to FIG. 1, the flaccid strap member 152 may be attached, by sewing or other desired technique to the inside, top, or outside of the ankle collar 30, or adjacent to the ankle collar 30.

While the strap 152 is preferably constructed from a woven material, a non-woven flexible strap or straps may be used. In one "in use position" shown in FIG. 1, strap member 152 is elongated over the rearward sizing member 200 and the ankle collar 30. In an alternative arrangement, the top portion 114 may have an extension of the forward sizing member 100 and may extend over the rearward sizing member 200 so as to attach directly to the ankle collar 30 or other outer portion of the heel section. This construction provides a highly styled appearance and also prevents debris from entering between the members 100 and 200 as well as the inner surface 33 of heel section. Thusly, the inside of the shoe 20 stays cleaner and fastening performance of the member 100 and member 200 to each other or to the inner surface 33 is improved. Because debris reduces the effectiveness of adhesives bonds, the alternative construction reduces the likelihood of premature separation when a releasable adhesive is used for fastening elements 112 and 212.

In alternative constructions, sizing apparatus 1 may incorporate some of the features of the previously described U.S. patent application Ser. No. 09/640,371. Such features may include a strip of material, strap 152, or other arrangement may include a preformed separation line to facilitate removal of the forward sizing member 100 from the shoe 20.

As shown in FIGS. 1–4, in a preferred construction of sizing apparatus 1, forward sizing member 100 and rearward sizing member 200 are attached together by at least one flexible attachment member 300. In one construction, the attachment member 300 may extend from the bottom end 101 of sizing member 100 and the attachment end 201 of rearward sizing member 200 as seen in FIGS. 3 and 4. In this construction, the sizing member 100 and member 200 are pivotally supported with respect to each other which enables, for example, the rearward sizing member 200 to swing into position behind forward sizing member 100. Thereafter, the rearward sizing member 200 mechanically couples to the forward sizing member 100 by engagement of the first fastening element 112 on rear covering 110 of forward member 100 and second fastening element 212 on rear covering 210 of rearward member 200.

Alternatively, sizing member 200 may swing "in front" of sizing member 100 and can be mechanically coupled to second fastening element, if a different fit performance is desirable for the intended sport of use. Accordingly, the rearward sizing member 200 has nearly 360 degrees of swing freedom as measured with respect to a reference plane extending substantially parallel to front covering 106 or rear covering 110 of the forward sizing member 100. That is, rearward sizing member 200 is pivotally and selectively positionable on the rear covering or front covering of forward sizing member 100 for use. In these ways, sizing apparatus 1 provides the wearer with adjustment the effective length and shoe for different fit characteristics for the sport of use to improve performance.

The attachment member 300 may be provided in a variety of forms, shapes, and materials. In a preferred construction, the attachment member 300 is provided with at least one flexible strap portion 302 interposed between the bottom end of sizing members 100 and 200. One end of the strap 302 may be sewn into the bottom end of forward sizing member 100 and the other opposing end of strap portion 302 may be sewn into the bottom end of rearward sizing member 200. In the depicted arrangement, another strap portion 304 may be provided and attached similarly as strap portion 302. In this construction, there are two straps in which the strap portions 302 and 304 may be disposed on the lateral and medial side in spaced apart condition to provide additional side-to-side stability of forward sizing member 100 and rearward sizing member 200 when coupled together. The strap portions 302 and 304 can be provided as a woven material, such as webbing material conventionally used in footwear.

In an alternative construction (not shown), the attachment member 300 may be formed as an extension portion of the front covering or rear covering of forward sizing member 100 and rearward sizing member 200. This construction provides the side-to-side stability of the members 100, 200 and can also reduce manufacturing costs because of fewer components for assembly. In yet another construction (not shown), the attachment member 300 may be a single piece of another material extending between the medial side 102 and lateral side 104 of sizing member 100. In lieu of a bottom end fixation, attachment member 300 may extend from the top end 114 of forward sizing member 100 and a free end 214 of rearward sizing member 200. In this case, the swing capability of rearward sizing member 200 is approximately 180 degrees with respect to the forward sizing member 100.

In one construction, the flexible attachment member 300 includes a detachment feature 310 so that the wearer may readily detach the rearward sizing member 200 from forward sizing member 100 to selectively change the size of shoe 20. In one case, the detachment feature 310 may be a detachment region to allow the wearer to manually remove, detach or breakaway the rearward sizing member 200 from forward sizing member 100, when the shoe 20 becomes tightly fitting. The detachment region may include a relatively narrow portion having a substantially lower tensile strength or lower breaking strength than the balance of the attachment member 300. Alternatively, the detachment region may have a lower tensile or breaking strength than the material forming front covering 106, 206 and rear covering 110, 210, respectively.

In one arrangement, the detachment region may include a material deformed by a series of spaced prescored perforations, an opposing "V" structure, or a grooved depression (not shown). The deformed material will generally lower the breaking strength along the detachment region relative to adjacent undeformed material. In the case of spaced perforations embodying the detachment region, the rearward sizing member 200 separates at the perforations by attachment member 300. This breakaway feature is helpful to eliminate using scissors. It should be appreciated that detachment equipment is not required for separation of the sizing members. Nevertheless, a cutting tool, such as a scissors, may be used to separate the rearward sizing member 200 from forward sizing member 100 and alternatively, separating forward sizing member 100 from upper 20.

In a preferred construction, the flaccid strap 152 and/or attachment member 300 may include instructional system 400 with visual representation or other indicia to associate the wearer to the specific region to detach or otherwise remove the attachment member 300 or flaccid strap 152. Moreover, the instructional representation indicates which sizing member 100 or sizing member 200 to remove first when the shoe becomes tightly fitting for the wearer. Because the shoe 20 may be worn by many individuals of different ages, experience levels and cultures, the instructional system provides benefits to a wearer for removing the sizing members in a particular order to selectively adjust the effective length of shoe 20.

The instructional system 400 could take on many different forms. Purely by way of example, as shown in FIG. 2, attachment member 300, in the form of strap portions 302 and 304, may include an symbolic instruction 402 in the form of an encircled "1". This instructional representation indicates that the strap portions should be removed or cut first. Thus, sizing member 200 would be removed from sizing member 200. Likewise, so as to indicate that forward sizing member 100 should be detached after rearward sizing member 200, flaccid strap 152 may have a symbolic instruction 404 in the form of an encircled "2" (see FIG. 3). Nevertheless, the instructional system 400 may include symbolic characters for communication in a variety of different languages. In these ways, the instructional system advantageously provides individuals with a quick reliable structure and method to eliminate premature disabling of the sizing apparatus 1 from shoe 20 and instructs the user on the order separation of the sizing members.

In one arrangement, strap member 152 can be used to form a rear loop pull tab. Strap member 152 may be elongated having a sufficient length to form a loop structure which can serve as an adjustable pull tab of the shoe 20 in combination with the forward sizing member 100 or rearward sizing member 200. The pull tab can assist the wearer in placing the shoe 20 on foot 42 when the forward sizing member 100 and/or rearward sizing member are disposed in "in use" positions in shoe 20.

Alternatively, strap 152 may be used to assist the alternate positioning of the sizing apparatus 1 on the outside of the upper 10. In such an arrangement, the sizing apparatus 1 may be folded due to its strap 152 to place the sizing member 100 on the outer surface of the heel section 28 of upper 10. Any desirable attachment technique can be used between the outside of the upper 10 and the sizing apparatus 1 to prevent the sizing apparatus 1 from moving while the shoe 20 is being worn. This permits the shoe 20 to retain its multi-sizing capability if the shoe 20 is given to another person after modification for the larger size. This function also allows the wearer, if desired, to place the sizing apparatus 1 outside of the shoe 20 for shipping or other purposes.

The effective length of the shoe 20 can incrementally changed for the wearer. Referring to FIG. 5A, the first effective length ($L_1$) of the shoe 20 is generally measured from the inner wall of the forefoot section 22 at the toe to the front covering 106 of forward sizing member 100 when rearward sizing member 200 is coupled thereto. As shown in FIG. 5B, the effective length of the shoe 20 increased from $L_1$ to $L_2$ based on the removal of the rearward sizing member 200 from the foot opening 31 and from forward sizing member 200. In FIG. 5C, the removal of forward sizing member 100 increases the effective length from $L_2$ to $L_3$. In sum, the overall removal or alternative positioning of the sizing apparatus 1 adjusted the overall effective length from $L_1$ to $L_3$, where $L_1$ is the smallest effective length and $L_3$ is the largest effective length on a relative basis.

In the "in use" position shown in FIGS. 1 and 6, the sizing apparatus 1 extends into the interior of the shoe 20 and moves spatially into the internal heel section 34, and creates a first effective length $L_1$ (see FIG. 5A). The sizing apparatus 1 is reliably retained within the internal heel section 34 by a mating arrangement as previously described, such as mechanical fasteners or the hooks on rear covering 210 and loop structure on the inner surface 33.

The user will continue to wear the shoe 20 under these conditions while his or her foot 42 grows. After the user's foot grows by a first predetermined size, the shoe 20 becomes tight fitting and signals the wearer to adjust the sizing of the shoe 20 to gain another wearable size without sacrificing a proper fit within normal ranges. To accomplish this, the rearward sizing member 200 can be removed or alternately positioned. First, the user can disengage the sizing member 200 from the heel section 28 by grasping the lateral side and/or medial side of the sizing apparatus 1 and pulling the forward sizing member 100 and rearward sizing member 200 away from the inner surface 33. This action creates a force that releases the rearward sizing member 200 from the mechanical bond of the second fastening element 212.

Next, the front covering 206 of rearward sizing member 200 is separated from the first fastening component 112 of forward sizing member 100. The disengaged sizing member 200, along with member 100, can be thereby placed in an intermediate or disengaged position and moved outside of the foot opening 31. In this position, the rearward sizing member 200 can be removed at the attachment member 300 by applying opposing pulling forces on opposite sides of detachment feature 310 or cutting at the predetermined area or other location between first and second sizing members. When the rearward sizing member 200 is disengaged from shoe 20, the second effective length is formed and the shoe 20 is usable up to the incremental increase in effective length of the shoe 20 or the difference in length between $L_2$ and $L_1$ (see FIG. 5B). In one arrangement, the incremental increase in effective length is substantially one-half shoe size.

The forward sizing member 100 is reset into the engaged position within the interior of the shoe 20. Fastening component 112 engages the inner surface 33 of heel section 34. After the user's foot grows by a second predetermined size, the shoe 20 becomes too tight fitting and signals the wearer to adjust the sizing of the shoe 20 to gain yet another wearable size without sacrificing a proper fit within normal ranges. Sizing member 100 is removed from the shoe interior and is removed from the upper 10. Advantageously, the disengagement of the rearward sizing member 200 from shoe 20, creates a third effective length formed and the shoe 20 is usable up to the incremental increase in effective length of the shoe 20 or the difference in length between $L_2$ and $L_3$ (see FIG. 5). While, the incremental increase in effective length is substantially one-half shoe size, the entire increment increase in effective length from $L_3$ to $L_1$ is substantially one full shoe size.

Hence, this sizing apparatus 1 system advantageously extends or increases the useful life of the shoe 20 for the particular wearer. This allows the wearer to continue using the shoe 20 for an additional portion of an athletic season or a full season depending on the pace the growth of the foot 40 of the wearer.

The shoe 20 may be designated for sale by the manufacturer by either its smaller effective length, and intermediate effective length, and its larger effective length. Under a standard shoe sizing system, the designation may correlate to the smaller effective length, that is the size of the shoe 20 with the forward sizing member 100 and rearward sizing member 200 engaged. For example, if the wearer initially had a foot size of 5, he or she would likely purchase a size 6 shoe, but the shoe would be designated as size 5 with sizing apparatus 1 for use. In a preferred embodiment, the forward sizing member 100 and rearward sizing member 200 have a thickness to affect the effective length of the shoe 20 to at least the next adjacent commonly sold and/or marketed and the following size. Thus, the sizing apparatus 1 will typically have a thickness to change the effective length of the shoe 20 by full size under the American standard sizing system. Therefore, in the engaged mode, the shoe will fit the size 5 foot 42 properly. As the foot 42 grows beyond a size 5 and approaches a size 5½, the shoe 20 will become tight fitting and the toes of the wearer will eventually contact or substantially contact the front of the upper 10 making the shoe 20 uncomfortable. The wearer or other person associated with the wearer preferably invokes the disengaged mode of the rearward sizing member 200 detaches it from the forward sizing member 100.

The removal of the sizing member 200 advantageously transforms or modifies the shoe 20 designated as a size 6 into a size 5½ based on the effective length. Thus, with the present invention, a wearer can purchase a size 6 and sequentially remove sizing member 200 and member 100 so that the shoe size is twice incrementally adjusted substantially a half shoe size. That is shoe is initially configured to an effective size 5, then an effective size 5½, and then to an effective size 6. In a preferred embodiment, the sizing apparatus 1 may advantageously permit the shoe 20 to be usable up to one or more additional athletic seasons. Thus, the useful life of the shoe 20 is extended beyond the conventional article of footwear. Alternatively, the sizing members 100, 200 may modify the effective length by less than a half-size to create a better fit within a half-size range. In a preferred embodiment under other shoe sizing denominations, it is also preferred to have the removal of the sizing system 1 increase the effective length of the shoe 20 by an amount sufficient to go from one commonly sold size to the next.

Referring to FIGS. 1–4, the upper 10 of the athletic shoe 20 is, but need not be, constructed of a material or a combination of materials thereof such as, split-leather, full-grain leather, suede, polyester, nylon, or a breathable mesh. The collar 32 and ankle collar 30 are preferably composed a cloth fabric or other materials intended for use as collars. The surface 33 of the internal heel area 34 may include a desirable lining material as shown in FIG. 6. The material for the surface 33 cooperates with the fastening elements 112, 212 on the rear covering 110, 220 of the sizing members 100 and 200, respectively. In a preferred embodiment, the lining material is woven such that it will function as mechanical loops to cooperate with the hook closures located on inner lining 110, 210. The sockliner 36 may be disposed inside of the shoe 20 is positioned between the foot 42 of the wearer and the sole 12. In addition, the sockliner 36 further includes an upper surface defining a footbed 35, which is the portion of the shoe 20 that is in contact with the bottom of the foot 42 of the wearer. The sockliner 36 provides additional cushioning, and shock absorption. The sockliner 36 may be preferably composed of polyester ethyl vinyl acetate (PEEVA) material having a thickness of 4.0 mm. The upper surface or footbed 35 of sockliner 36 may be generally composed of a knit fabric mounted or bounded to the PEEVA material.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention include all embodiments falling within the scope of the appended claims.

What is claimed is:

1. An article of footwear, comprising:

a sole;

an upper including a forward portion, a rear portion, and a foot opening in the rear portion positioned to receive a foot when worn, and the rear portion of the upper including a heel section disposed at the foot opening extending from the sole; and a sizing apparatus configured to be positionable within the heel section for engaging a foot of a wearer, the sizing apparatus including a first removable member and a second removable member, in which the first removable member and second removable member are adapted to be in substantially vertical superimposition with respect each other and to the heel section, the first removable member being attached to a portion of the heel section, and the second removable member being pivotally attached to the first removable member.

2. The article of footwear in accordance with claim 1, in which the first removable member further includes a fastening portion permitting said first removable member to be releasably coupleable to an outer surface of the second removable member.

3. The article of footwear in accordance with claim 2, in which the fastening portion permits the first removable member to be releasably coupleable to the inner surface of the heel section when the second removable member is at least pivoted away from the heel section.

4. The article of footwear in accordance with claim 2, in which the second removable member further includes an opposing outer surface to said outer surface, said opposing outer surface including a mating portion adapted to releasably couple the inner surface of the heel section when the second removable member is positioned between the first removeable member and the heel section.

5. The article of footwear in accordance with claim 4, in which one said fastening portion and said mating portion includes a plurality of hooks.

6. The article of footwear in accordance with claim 1, in which the first removable member and the second removable member each include an inner core composed of a compressible material.

7. The article of footwear in accordance with claim 1, in which the one of the first removable member and second removable member includes a bifurcated inner core.

8. The article of footwear in accordance with claim 7, in which the bifurcated inner core includes at least two different compressible members.

9. The article of footwear in accordance with claim 7, in which the bifurcated inner core includes a first resilient member and a second resilient member in which the resiliency of the first resilient member and the second resilient member are different.

10. The article of footwear in accordance with claim 9, in which the first resilient member includes a forwardly disposed portion which is adapted to receive a portion of the heel tendon of a foot of a wearer.

11. The article of footwear in accordance with claim 9, in which the first resilient member includes a medial portion, a lateral portion, and a central portion disposed between the medial portion and the lateral portion, wherein the medial portion and the lateral portion have a greater thickness than a thickness of the central portion so as to form a cradle to receive a portion of a heel tendon of a foot of a wearer.

12. The article of footwear in accordance with claim 1, further comprising a flexible attachment element having a first end and a second end, the first end of the attachment element being attached to the first removable member and the second end being attached to the second removable member, the attachment element configured to provide pivotal movement of the second removable member with respect to the first removable member.

13. The article of footwear in accordance with claim 12, wherein the flexible attachment element is a woven flaccid strap member.

14. The article of footwear in accordance with claim 13, in which the attachment element further includes a first separation region for detachment of the second removable member from the first removable member, the strap member further includes a second separation region for detachment of the first removable member from the upper.

15. The article of footwear in accordance with claim 1, in which the sizing apparatus further includes an instructional system, having indicia to instruct the user the order separation of the first removable member and the second removable member of the sizing apparatus, respectively.

16. The article of footwear in accordance with claim 12, further comprising a at least two of flexible straps each having a first end and a second end, the first end of the straps being attached to the first removable member and the second ends being attached to the second removable member, the straps configured to provide pivotal movement of the second removable member with respect to the first removable member and the straps being spaced between medial and lateral sides of the first removable member.

17. The article of footwear in accordance with claim 1, in which the second removable member is positionable between the first removable member and the heel section of the upper.

18. The article of footwear in accordance with claim 1, in which each of the first removable member and the second removable member has a thickness that affects an effective length of the shoe by an amount substantially equal to a one-half shoe size.

19. An article of footwear, comprising:

a sole;

an upper extending from the sole, the upper including a heel portion being within a foot opening being configured to receive a foot when worn; and an articulated sizing system configured for engaging a foot of a user within the heel portion, the sizing system including a first sizing element and a second sizing element coupleable together to form a first effective length of the upper, said first sizing element configurable to adjust a second effective length of the upper excluding said second sizing element from within said heel portion, at least one of the first sizing element and the second sizing element being removably attached to the upper to adjust a third effective length of the upper.

20. The article of footwear in accordance with claim 19, in which the first sizing element and the second sizing element are removably attached to each other.

21. The article of footwear in accordance with claim 20, in which one of the first sizing element and the second sizing element includes a composite compressible inner core and one of the other includes a single compressible inner core.

22. The article of footwear in accordance with claim 21, in which the composite compressible inner core is adapted to receive a portion of a heel of a foot of a wearer.

23. The article of footwear in accordance with claim 21, in which the composite compressible inner core includes a first region, a second region, and a intermediate region disposed between the first region and the second region, the first region and the second region being an equal thickness, the intermediate region having a thickness smaller than the thickness of the first region and the second region so as to form a pocket to receive a portion of a heel tendon of a foot of a wearer.

24. The article of footwear in accordance with claim 20, further including at least two spaced extension elements attached to the first sizing element and the second sizing element, the extension elements being bendable for pivotable movement of the first sizing element and the second sizing element with respect to each other.

25. The article of footwear in accordance with claim 19, in which the third effective length is substantially equaled to a full shoe size.

26. An article of footwear having a sole, an upper extending from the sole, and a foot opening positioned to receive a foot when worn, an adjustable shoe sizing system, comprising:

a first member configured to be removably coupleable to a heel portion of the upper adjacent the foot opening enabling a user to adjust a first effective length of the article of footwear by substantially one-half size;

a second member configured to be pivotally coupled to the first member and releasably matable therewith enabling a user to adjust a second effective length of the article of footwear to substantially a full size.

27. The article of footwear in accordance with claim 26, further including an elongated strap attached to the first member and attached to the heel portion of the upper, said elongated strap forming an adjustable heel tab of the upper.

28. The article of footwear in accordance with claim 26, further comprising an attachment element having a first end and a second end, said first end of the attachment element being attached the first member and said second end of the attachment being attached the second member.

29. The article of footwear in accordance with claim 28, further comprising a strap member having a first end and a second end, said first end of the strap member being attached to the first member and the second end of the strap member being removably coupleable to a heel portion of the upper.

30. The article of footwear in accordance with claim 29, in which the attachment element further includes a first separation region disposed for detachment of the second member from the first member, and the strap member further including a second separation region for detachment of the first member from the upper.

31. The article of footwear in accordance with claim 30, further including an indicia corresponding to the first separation region and the second separation region for indicating which an order of detachment of the first member and the second member.

32. The article of footwear in accordance with claim 26, in which the first member includes a composite compressible inner core.

33. The article of footwear in accordance with claim 32, in which the composite compressible inner core further includes a first region, a second region, and a central region disposed between the first region and the second region, the first region and the second region being an equal thickness, the central region have a thickness smaller than the thickness of the first region and the second region.

34. The article of footwear in accordance with claim 33, in which the first region, the second region, and the central region are integrally formed of a single material.

35. A method of adjusting the effective length of an article of footwear having a sole, an upper extending from the sole and a foot opening for receiving the foot of a wearer in which a sizing apparatus is configurable to be positioned within the foot opening and attached to the upper, the sizing apparatus having a first sizing member and a second sizing member, the method comprising the steps of:

positioning the sizing apparatus within the foot opening to create a first effective length, wherein the sizing apparatus mates with a rear panel of the upper;

creating a second effective length by removing the first sizing member from the foot opening; and creating a third effective length by removing the second sizing member from the foot opening.

36. The method of claim 35, wherein the step of positioning further comprises a step of mating the first sizing member and the second sizing member.

37. The method of claim 36, wherein the step of creating a second effective length further comprises a step of separating the first sizing member and the second sizing member from each other along a predetermined separation region.

* * * * *